United States Patent [19]

Paulson

[11] Patent Number: 5,046,417

[45] Date of Patent: Sep. 10, 1991

[54] VAPOR FILM EQUALIZER DAMPENING SYSTEM FOR PRINTING PLATE CYLINDER

[76] Inventor: Harold E. Paulson, 360 Wynland Trace, Dunwoody, Ga. 30350

[21] Appl. No.: 590,957

[22] Filed: Oct. 1, 1990

[51] Int. Cl.[5] ..... B41F 7/26; B41F 7/32; B41L 25/02; B41M 25/18

[52] U.S. Cl. ..... 101/148; 101/450.1

[58] Field of Search ..... 101/147, 148, 350, 363, 101/349, 132.5, 450.1, 483, 207-210; 29/120, 132

[56] References Cited

U.S. PATENT DOCUMENTS

| | | | |
|---|---|---|---|
| 4,016,811 | 4/1977 | Zavodny | 101/148 |
| 4,048,919 | 9/1977 | Woods | 101/148 |
| 4,724,764 | 2/1988 | MacPhee et al. | 101/148 |

*Primary Examiner*—J. Reed Fisher
*Attorney, Agent, or Firm*—Jacobson and Johnson

[57] ABSTRACT

A tray contains frothed or bubbly solution for applying to a printing cylinder plate and a cylindrical pan roller having a microporous outer layer is continuously rotated in the frothed solution to continuously absorb or pick up small amounts of the solution. Solution is transferred from the pan roller to a metering roller, having a surface of highly polished chrome, by rolling contact between the two rollers. In turn, the metering roller transfers liquid to a form roller which has a microporous outer surface in rolling contact with a printing plate mounted on the printing press printing cylinder for depositing the liquid solution onto the printing plate as the printing cylinder rotates. The pan roller and the form roller have hollow cores and pressurized air at a very low pressure is applied to the cores to uniformly spread the liquid throughout the microporous surface for uniform distribution. The form roller is provided with air vanes or blades mounted around its shaft and pressurized air is applied to the air vanes to insure that the form roller continues rotating even when not in contact with the rotating printing plate.

8 Claims, 2 Drawing Sheets

12
11
13
21
14
10

12
13

10
11
21
14

VAPOR FILM EQUALIZER DAMPENING SYSTEM FOR PRINTING PLATE CYLINDER

FIELD OF THE INVENTION

The invention is used to apply a uniform vapor-like film of anti-linking liquid over a printing plate mounted on a printing cylinder as the printing cylinder rotates in a printing press. It involves transferring frothy or bubbly liquid from a pan to the printing cylinder through a series of rollers.

DESCRIPTION OF THE PRIOR ART

One type of prior system involved the use of a ductor roll covered with terry cloth that picked up liquid from a chrome plated pan roll and moved the liquid to a chrome covered oscillator roller that in turn distributed the liquid to the plate cylinder roll. The main problem of this type of system was in trying to keep the terry cloth covered rolls clean and trying to prevent excess moisture from being applied to the printing plate.

Another system fed the liquid solution directly to the inking system or used one of the ink form rollers as a dampener roller.

Yet another system sprays the liquid solution directly onto the plate cylinder.

Yet another system utilizes a series of rubber covered rollers to transfer the liquid from the pan to the plate.

Another example of a prior art system is illustrated in my U.S. Pat. No. 3,990,365 titled "CYLINDER MOISTENING DEVICE" which uses air to send a fine spray of liquid onto a water cylinder which then deposits the liquid on the printing cylinder.

All of these systems have operated successfully but still have had problems of emulsification, roll glazing, roll cracking, and swelling that cause excessive wear on the printing plate image and reduce the quality of the printed product. Some of these problems are attributable in part to the solution itself. The art has developed a reliable stabilized solution so that some, if not all, of the problems attributable in part to the solution in the past have now been virtually eliminated. To keep step with the improvement in the solution, it is necessary to provide a dampener which will apply the liquid in a vapor-like film uniformly on the plate thereby reducing glazing and provide smoother solids of the printed product.

SUMMARY OF THE INVENTION

The liquid solution which is to be applied to the printing plate cylinder is aerated in a pan so that the pan is filled with bubbly or frothy liquid solution. A pan roller having a hollow core and an outer microporous surface is rotated through the frothy liquid and makes surface contact with a highly-polished chrome-finish metering roller so that liquid is passed on to the metering roller. In turn, the metering roller is in contact with the outer surface of a form roller also having a hollow core and a microporous outer surface and the liquid is transferred from the metering roller to the form roller. The latter in turn has its surface in rolling contact with the plate on the rotating printing plate cylinder and applies the liquid uniformly in a very thin vapor-like film onto the printing plate. The aerated solution minimizes the chance of any glazing occurring. Low pressure pressurized air may be applied to the hollow cores of the pan and form roller to uniformly spread the liquid over the entire outer surface of the microporous covering and also to keep the pores free as the moisture is transferred to the next roller. This further assures that the solution is applied uniformly across the entire printing cylinder.

As a further feature, the form roller has a set of vanes or blades attached around its shaft and pressurized air is applied to the vanes to ensure that the form roller continues rotating while the printing plate cylinder is rotating. In normal use there is often a small gap between the ends of the printing plate which is mounted on the printing cylinder so that the speed of rotation of the form roller would be reduced (or it might even possibly stop) in that gap. This ends up with an uneven distribution of the solution in the plate. The use of pressurized air applied to the vanes to keep the form cylinder rotating substantially eliminates this problem.

DESCRIPTION OF THE PREFERRED EMBODIMENTS

Figure 1:
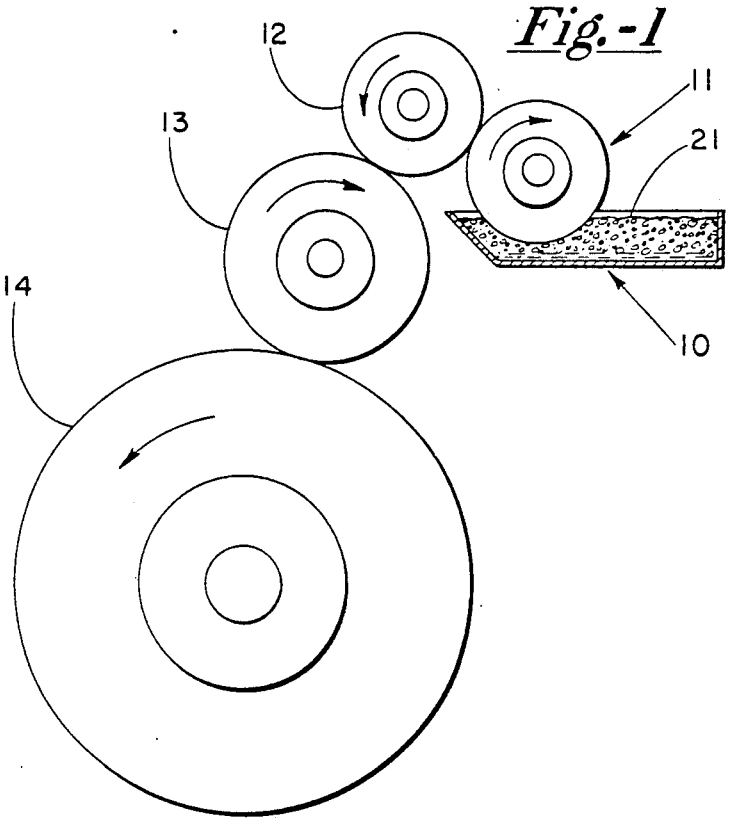
FIG. 1 is a schematic illustration of a preferred embodiment of the instant invention.
Figure 2:
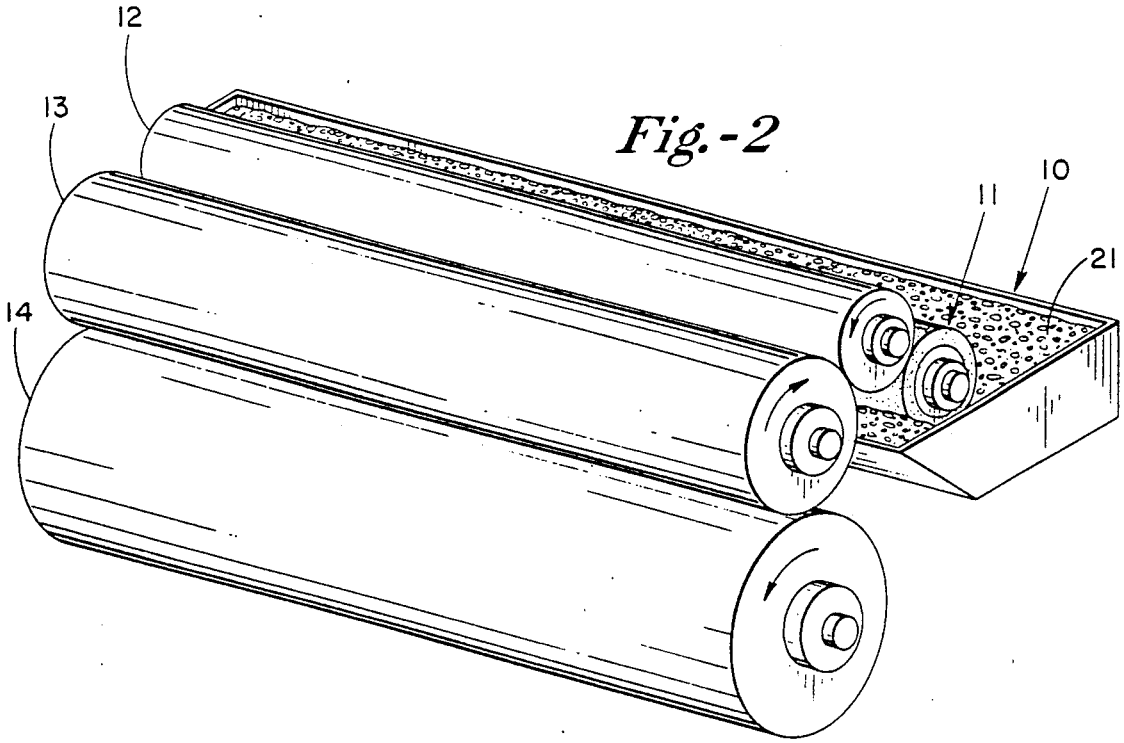
FIG. 2 is a perspective view of the roller arrangement in the preferred embodiment.
Figure 3:
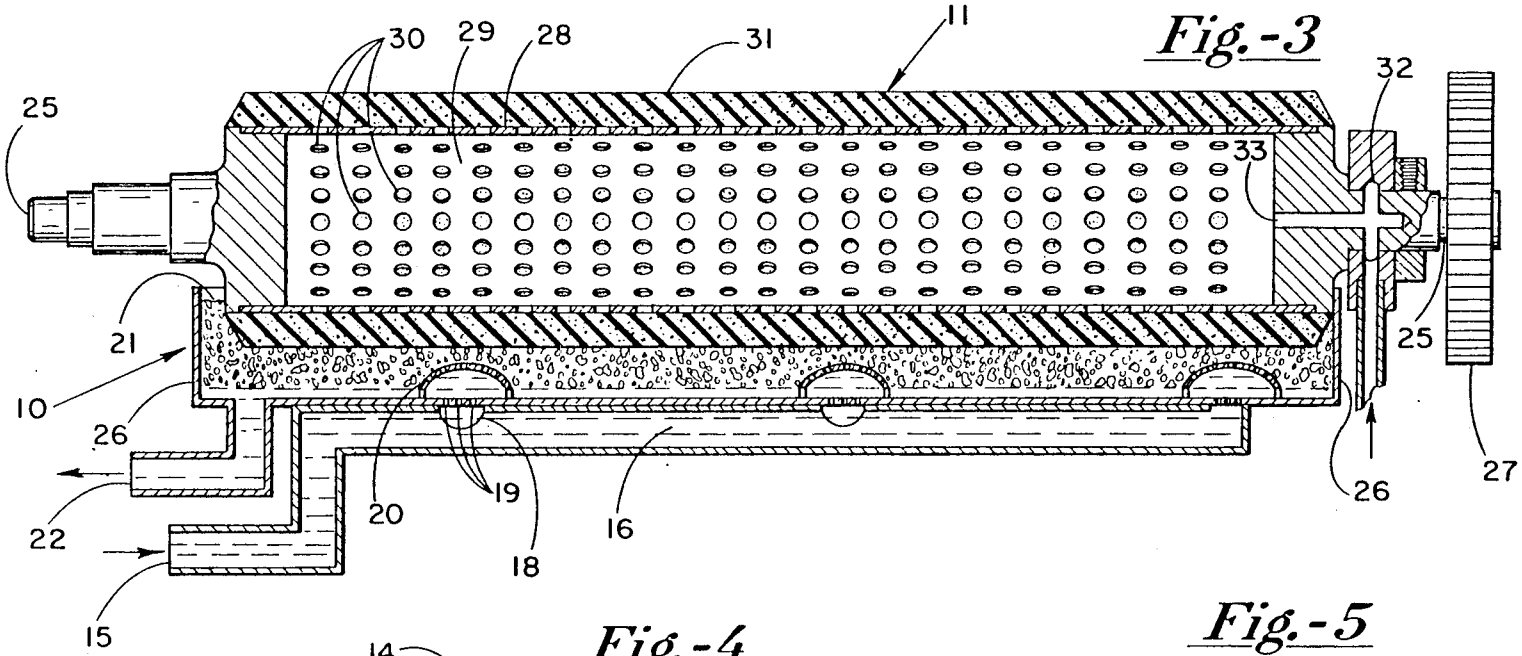
FIG. 3 is a partial section view illustrating details of construction of the pan roller and the liquid aerating system utilized in a preferred embodiment of the invention.
Figure 5:
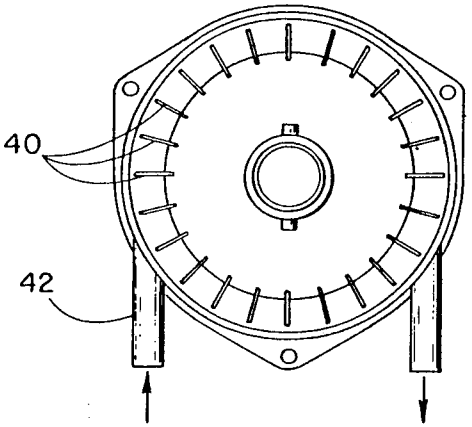
FIG. 5 is an end view of the vanes for driving the form roller.
Figure 4:
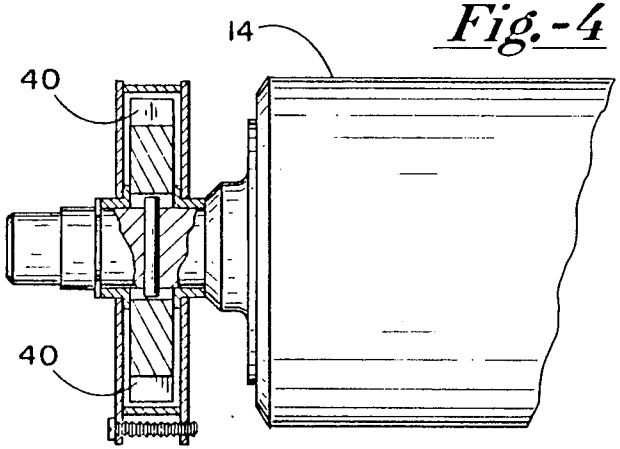
FIG. 4 is a partial sectioned view of the air vanes for driving the form roller in a preferred embodiment of the invention.

Referring first to FIG. 1, functionally the preferred embodiment of the instant invention comprises a pan or tray 10 substantially filled with aerated bubbly or frothy liquid solution 21 with an elongated cylindrical pan roller 11 at least partly immersed in the frothy solution for picking up or at least partially absorbing the bubbly solution, an elongated cylindrical metering roller 12 axially parallel to the pan roller 11 and in surface contact therewith for transferring the solution from pan roller 11 to metering roller 12, another elongated cylindrical roller, form roller 13, axially parallel to the other two rollers in surface contact with metering roller 12 for transferring liquid from the latter. Form roller 13 is in surface contact with a printing plate, not separately designated by a reference number, which is attached to the outer surface of the printing press printing cylinder 14 for transferring the solution from form roller 13 onto the printing plate. Conventionally the ends of the shafts of each of the rollers are suitably mounted on bearings, not shown, and metering roller 12 and pan roller 11 are directly driven by gears mounted on their shafts and geared back to a motor. The gears and motor are not shown since they are conventional and are not considered to be part of the instant invention. Preferably the speed of the motor is adjustable to adjust the rate at which pan roller 11 picks up solution from the frothy solution 21 in pan 10.

The solution 21 is preferably a mixture of water with an etchant and arabic gum. This is conventional and the etchant and arabic gum are commercially available. One of ordinary skill in the printing art will ordinarily determine the best solution for a particular application and will either obtain the ingredients and mix them together in suitable ratios or purchase a commercially available ready-mixed solution. It should also be mentioned here that conventionally there are a series of inking rollers, not shown, which transfer ink from a suitable source to the outer surface of the printing plate on the printing cylinder.

The suitably mixed solution comes from a reservoir, not shown, through a pump, also not shown, into the inlet 15 of a tubular liquid passageway 16 located at the bottom of tray 10. At spaced locations there are openings 18 from liquid passage 16 up through the bottom of pan 10 through which the solution enters into the pan. The openings 18 are covered with tiny pinholes 19 so that the pressurized solution enters into the bottom of pan or tray 10 through openings 18 in very fine streams or sprays. Spaced upward over each of the openings 18 is an arced or mushroom-shaped diffuser or reflector 20. When the solution spray strikes the curved underside of reflector 20, it breaks up into a bubbly or frothy form 21 which substantially fills the interior of pan 10. Naturally, as the bubbles or froth break up and disappear they form a shallow stream of liquid at the bottom of pan 20 which returns to the liquid source through an exit port 22.

Axial shaft 25 of pan roller 11 is suitably rotatably mounted at each end in the sides 26 of pan 10 or outside pan 10, in a manner not shown, so that roller 11 will rotate and preferably always be at least half submerged in the frothy or bubbly liquid 21 contained in pan 10. As mentioned earlier, pan roller 11 preferably is driven by a motor, not shown, through a gear 27 attached to shaft 25. Pan roller 11 comprises a stiff supporting cylindrical shell 28 having a hollow core 29. Shell 28 may be made of thin yet relatively stiff metal with apertures 30 punched or machined therethrough or it may be made of a relatively stiff mesh or wire. In any event, shell 28 is coarsely porous yet rigid enough to hold an outer microporous layer 31 firmly in place. Hollow core 29 is closed off at both ends except for an air inlet opening at one end from passageway 33. Covering over cylindrical shell 28 is a layer 31 of microporous material. Layer 31 may be made of a soft rubber or foam rubber or any material of a similar nature which has micro-miniature pores which will pick up or absorb some of the bubbly solution 21 as pan roller 11 rotates through it. Pressurized air at a very low pressure, just slightly above atmospheric, from a source not shown enters through a radial opening 32 into axial passageway 33 in shaft 25 which is open at one end to provide air communication with the hollow core 29 of pan roller 11. The pressurized air in the hollow core of roller 11 passes generally radially outward into layer 31 through the coarse openings 30 of shell 28. The pressurized air serves the purpose of making sure that the solution that's picked up by covering layer 31, as pan roller 11 continuously rotates through the bubbly solution, is uniformly distributed over the entire outer surface of roller 11. It also serves to keep the miniscule or micro-miniature pores of layer 31 clear, i.e., to make sure they don't get closed or clogged up with any impurities that might find their way into the liquid solution. The pressurized air is not so great that it will keep the solution from entering the pores of layer 31. It is difficult to explain to a great degree of scientific accuracy how this low pressure pressurized air produces the results it does but suffice is to say that it assists in the transfer of solution from pan roller 11 so that ultimately a uniform thin coating or film of the solution is produced on the printing plate mounted on printing plate cylinder 14.

The outer surface of metering roller 12 is a highly polished chrome-plated finish. Roller 12 is suitably rotatably mounted at both ends and, as mentioned earlier, is driven by gear engagement with an adjustable speed motor, not shown. The surface of metering roller 12 is in rolling contact with the outer microporous surface 31 of pan roller 11. Despite its highly polished finish, the surface of the metering roller is somewhat hydropholic or has enough affinity for the solution that some of the solution is transferred onto its outer surface from contact with pan roller 11. The highly polished surface of metering roller 12 produces a uniform thin coating of solution across it.

Form roller 13 is constructed in the same fashion as pan roller 11 with a stiff coarsely porous hollow cylindrical shell covered with a layer of microporous material, such as foam rubber or the like, and has a passageway in its mounting shaft for applying low pressure pressurized air to its interior hollow core. This air operates in the same fashion as it does in pan roller 11 to uniformly distribute the solution, which is transferred from the surface of metering roller 12 to the outer porous surface of form roller 13, and uniformly deposit it on the surface of the printing plate mounted on the rotating printing cylinder 14.

Form roller 13 is not motor driven and basically rotates by virtue of its rolling contact with printing plate cylinder 14. As mentioned earlier, commonly when the printing plate is mounted on the printing cylinder there is a gap between the two ends of the plate. Even though printing plate cylinder 14 generally rotates at quite a high speed, during the short gap between the ends of the printing plate the speed of rotation of form roller 13 is slightly reduced which often results in a non-uniform transfer of the solution onto the printing plate. This will then result in a defect in the quality and uniformity of the printed product. To remedy this, a set of vanes or blades 40 is mounted circularly around the shaft of form roller 13 and an air spout 42 connected to a source of pressurized air, not shown, is directed to cause a stream of air to impinge upon vanes 40 so that the form roller 13 is being continually driven at a constant speed thereby avoiding or eliminating the possibility of a slowdown of rotation of form roller 13 in the gap between the ends of the printing plate which might otherwise result in a defective printed product.

I claim:

1. In a printing press, a system for applying to the surface of a printing plate on a printing cylinder a thin coating film of an anti-inking liquid solution, comprising:

a container of anti-inking liquid solution for coating the surface of a printing cylinder;

an axially rotatable pan roller partially immersed in said liquid solution, said pan roller comprising a hollow core surrounded by a coarsely porous rigid tubular support having an outer covering layer of microporous material;

an axially rotatable metering roller having an outer surface of highly polished chrome finish, the axis of said metering roller parallel to said pan roller with the outer surfaces of said pan roller and said metering roller being in contact for transferring liquid solution from said pan roller to said metering roller;

a form roller axially rotatable parallel to said metering roller, the outer surface of said form roller being in contact with the outer surface of said metering roller for transferring liquid solution from said metering roller to said form roller;

the outer surface of said form roller being in contact with the surface of a printing plate on a rotatable printing press printing cylinder for transferring liquid solution from said form roller to said printing plate.

2. The liquid solution applying system for a printing plate on a printing press printing cylinder as described in claim 1 further including:

means for feeding very low pressurized air into the core of said pan roller.

3. The liquid applying system for a printing plate on a printing press printing cylinder as in claim 2 further including a series of vanes attached to the shaft of said form roller; and means for applying air against said vanes for axially rotating said form roller.

4. The liquid applying system for a printing plate on a printing press printing cylinder as in claim 1 further including;

means for frothing the liquid solution in said container, said pan roller partly immersed in said frothy liquid.

5. The liquid applying system for a printing plate on a printing press printing cylinder as in claim 4 wherein:

said form roller comprises a hollow core surrounded by a coarsely porous rigid tubular support having an outer covering of microporous material; and further including means for feeding pressurized air at a very low pressure into the core of said form roller.

6. A method for dampening the surface of a printing plate on a printing press printing cylinder with a thin uniform coating of anti-inking liquid solution from a container, comprising the steps of:

a) frothing the anti-inking liquid solution in the container;

b) removing said anti-inking liquid solution from the container by axially rotating in the frothed solution a first hollow-core roller having a liquid-absorbing microporous outer surface;

c) transferring said solution from said first roller to the outer surface of intermediate roller means by surface contact between said first roller and said intermediate roller means; and transferring solution to the printing plate on the printing press printing cylinder by surface contact between said intermediate roller means and said printing plate.

7. The printing plate dampening method as recited in claim 6 further including the step of feeding low pressure pressurized air to be hollow core of said first roller for spreading the liquid absorbed by said first roller uniformly over said first roller.

8. The printing plate dampening method as recited in claim 7 wherein said intermediate roller means comprises a second axially rotatable roller in surface contact with said first roller and a third axially rotatable roller having a hollow core and a microporous outer covering in surface contact with said second roller and in surface contact with the printing plate on the printing press printing cylinder and including the further step of feeding low pressure pressurized air into the hollow core of said third roller for uniformly spreading the anti-inking liquid solution over the microporous covering layer of said third roller.

* * * * *